US006167724B1

(12) United States Patent
Pozivil

(10) Patent No.: US 6,167,724 B1
(45) Date of Patent: Jan. 2, 2001

(54) PUMP

(75) Inventor: Josef Pozivil, Allschwil (CH)

(73) Assignee: The BOC Group plc, Windlesham (GB)

( * ) Notice: Under 35 U.S.C. 154(b), the term of this patent shall be extended for 0 days.

(21) Appl. No.: 09/312,163

(22) Filed: May 14, 1999

(30) Foreign Application Priority Data

May 19, 1998 (GB) ..... 9810587

(51) Int. Cl.[7] ..... F25J 3/00; F04B 3/00
(52) U.S. Cl. ..... 62/653; 62/654; 417/251
(58) Field of Search ..... 62/653, 654, 50.6; 417/251, 423.5

(56) References Cited

U.S. PATENT DOCUMENTS 5,341,647 * 8/1994 Koeberle et al. ..... 62/654
5,575,626 * 11/1996 Brown et al. ..... 417/251
5,799,510 * 9/1998 Mostello ..... 62/653

FOREIGN PATENT DOCUMENTS 0604390 6/1994 (EP) .
216893 6/1994 (GB) .

* cited by examiner

*Primary Examiner*—William Doerrler
(74) *Attorney, Agent, or Firm*—Salvatore P. Pace

(57) ABSTRACT

A cryogenic rotary pump for pressurizing a flow of a cryogenic liquid and for dividing the flow into a first lower pressure and a second higher pressure stream has a series of pumping chambers. A single rotary drive shaft carries a rotary inducer located in the chamber, a first impeller in the chamber, and a second impeller in the chamber. A liquid receiving chamber is located intermediate the pumping chambers. A first outlet from the pump for the first lower pressure stream is contiguous to the chamber and a second outlet is provided for the second higher pressure stream. The pump may serve to pressurize a flow of unboiled liquid oxygen from a sump of a lower pressure column of a double column also having a higher pressure column.

10 Claims, 6 Drawing Sheets

PUMP

BACKGROUND OF THE INVENTION

This invention relates to a pump, more particularly to a cryogenic rotary pump and to a cryogenic air separation apparatus including the pump.

A cryogenic rotary pump conventionally contains one or more pumping chambers. The or each pumping chamber is, in operation, swept by a rotary pumping member. The rotary pumping members are carried on a shaft which is typically driven directly by an electric motor. The number of pumping chambers and/or pump speed depends on the pressure to which it is required to raise a cryogenic liquid by the pump.

Such cryogenic rotary pumps may be used to perform any one of a number of different duties. Cryogenic rotary pumps are, for example, widely used in cryogenic air separation plants. Such plants or apparatus typically include a double rectification column, for separating the air, comprising a higher pressure column, a lower pressure column and a condenser-reboiler placing an upper region of the higher pressure column in heat exchange relationship with a lower region of the lower pressure column. The condenser-reboiler is typically located in or above a sump in which a liquid oxygen fraction separated in the lower pressure column collects. Conventionally, the reboiling section operates as a thermosiphon. Therefore no external electrical pump is required to urge the liquid oxygen through the reboiler. One disadvantage of a thermosiphon is that liquid head effects result in a temperature difference between boiling liquid and condensing vapour greater than would otherwise be necessary, thereby adding to the thermodynamic inefficiency of the operation of the condenser-reboiler in operation. Accordingly, downflow reboilers are now used as an alternative to thermosiphon reboilers. In such downflow reboilers the liquid to be boiled is distributed to a header at the top of the boiling passages and flows down these passages. In the case of liquid oxygen, it is considered unsafe to operate the reboiler with dry areas on the boiling surfaces. Accordingly, only a portion of the liquid oxygen is boiled and there is a need to pump to the distributor an appreciable flow of liquid oxygen. A cryogenic rotary pump can be used for this function.

Another use for a cryogenic rotary pump in a cryogenic air separation plant is to pump a liquid oxygen product to a relatively high pressure, sometimes above the critical pressure of oxygen. The thus pressurised oxygen is warmed so as to provide an elevated pressure product at approximately ambient temperature. One advantage of such an arrangement is the need for an oxygen gas compressor, the operation of which can be hazardous, is avoided.

Modern air separation plants are increasingly designed to produce an elevated pressure gas oxygen product and with downflow reboilers. Typically two separate cryogenic rotary pumps are employed to perform these functions, although when the pressure of the oxygen product is in the order of 10 bar or less, it is known to reduce the pressure of a sidestream of the pumped liquid oxygen and introduce it into the downflow reboiler. Since the recycle flow to the downflow reboiler can exceed the flow rate of oxygen product out of the plant, such a practice is particularly inefficient.

It is an aim of the present invention to provide a rotary cryogenic pump which can perform a plurality of pumping duties relatively efficiently.

SUMMARY OF THE INVENTION

According to a first aspect of the present invention there is provided a cryogenic rotary pump for pressurising a flow of a cryogenic liquid and for dividing the flow into a first lower pressure stream and a second higher pressure stream, including a plurality of pumping chambers in series with one another, a single rotary drive shaft carrying all rotary pumping members, a liquid receiving chamber intermediate a pair of pumping chambers, a first outlet from the pump for the lower pressure stream, the first outlet being contiguous to the liquid receiving chamber, and a second outlet from the pump for the second higher pressure stream downstream of the series of pumping chambers.

According to the second aspect of the present invention there is provided cryogenic air separation apparatus including a double rectification column for separating the air, comprising a higher pressure column, a lower pressure column, and a condenser—reboiler placing an upper region of the higher pressure column in heat exchange relationship with a lower region of the lower pressure rectification column, wherein the reboiler is of a downflow kind having generally vertical boiling passages communicating with a sump, there being an outlet for liquid oxygen from the sump, characterised in that the outlet for liquid oxygen communicates with a cryogenic rotary pump according to the first aspect of the invention and that the first outlet of the cryogenic rotary pump communicates with an inlet of the reboiler for liquid oxygen and the second outlet of the cryogenic rotary pump communicates with heat exchange means for warming the oxygen.

By appropriate selection of the pumping members and the number of pumping chambers, and/or the pump speed, the first stream can be produced at a pressure not significantly above that required to lift the stream to the top of the reboiler, typically a distance in the range of 10 to 20 meters, and the second stream can be produced typically at a pressure in the range of 10 to 60 bar. An advantage of a cryogenic rotary pump according to the first aspect of the invention is that a single drive shaft (which therefore requires only a single electric or other motor to drive it) carries all the rotary pumping members. Duplication of motors and associated electrical switch gear is therefore avoided. In addition, only one pump inlet liquid line equipped with a shut-off valve is required. When the cryogenic rotary pump according to the first aspect of the invention is used in a cryogenic air separation apparatus according to the second aspect of the invention, the ability to avoid duplication of motors and electrical switch gear and pump inlet liquid lines (equipped with shut-off valves) makes possible a reduction in the size of the insulating housing, known as a "cold box", in which the cryogenic parts of the apparatus are housed.

There is preferably only one pumping chamber upstream of the liquid receiving chamber. The pumping member in this upstream chamber is typically an inducer comprising a helical blade of constant or varying pitch or other axial or radial pumping member dependent on the required pumping duty. For an inducer, the helix preferably performs 1½ to 2½ complete turns, i.e. extends through an angle in the range of 540 to 900° for low NPSH (net positive suction head) requirements.

The precise pressure at which the first stream leaves the first outlet depends in part on the pitch or diameter of the blade or the pumping member speed. Accordingly, for an upstream pumping chamber of given size, and for a given pumping member speed (which may be dictated by the speed at which downstream pumping members are intended to operate) the outlet pressure of the first stream can be selected from an albeit relatively small range of pressures by appropriate choice of the precise dimensions of the helical blade. Preferably, the or each pumping chamber downstream of the liquid receiving chamber has associated therewith a radial rotary pumping member, typically taking the form of an impeller having blades which urge the fluid being pumped in a generally radial direction.

Preferably, there is an axial or radial diffuser, or three dimensional (axial/radial) diffuser, located downstream of each pumping member. If desired, the blades of the radial diffuser may be of a variable angle kind.

The number of pumping chambers and the rotational speed of their pumping members downstream of the liquid receiving chamber depends on the pressure to which it is desired to raise the second stream. If, for example, the second stream is required at a pressure in the order of 10 to 12 bar, there may be a single radial pumping chamber downstream of the liquid receiving chamber. If, however, the second stream is required at a pressure in the order of 60 bar, there may be a series of four to eight radial pumping chambers, or more, downstream of the liquid receiving chamber.

Preferably, the drive shaft is driven directly by a single electric motor.

A variable speed electrical motor is preferably employed. Such a motor enables the outlet pressure of the second stream to be varied albeit within a relatively narrow range of pressures. However, by appropriate selection of the number of pumping stages downstream of the liquid receiving chamber and appropriate selection of the motor speed it is possible to design a pump according to the invention to give any desired second stream outlet pressure in the range of 10 to 60 bar or more.

BRIEF DESCRIPTION OF THE DRAWINGS

Apparatus as according to the two aspects of the invention will now be described by way of example with reference to the accompanying drawings, in which.

The drawings are not necessarily to scale.

DETAILED DESCRIPTION OF THE INVENTION

Figure 1A:
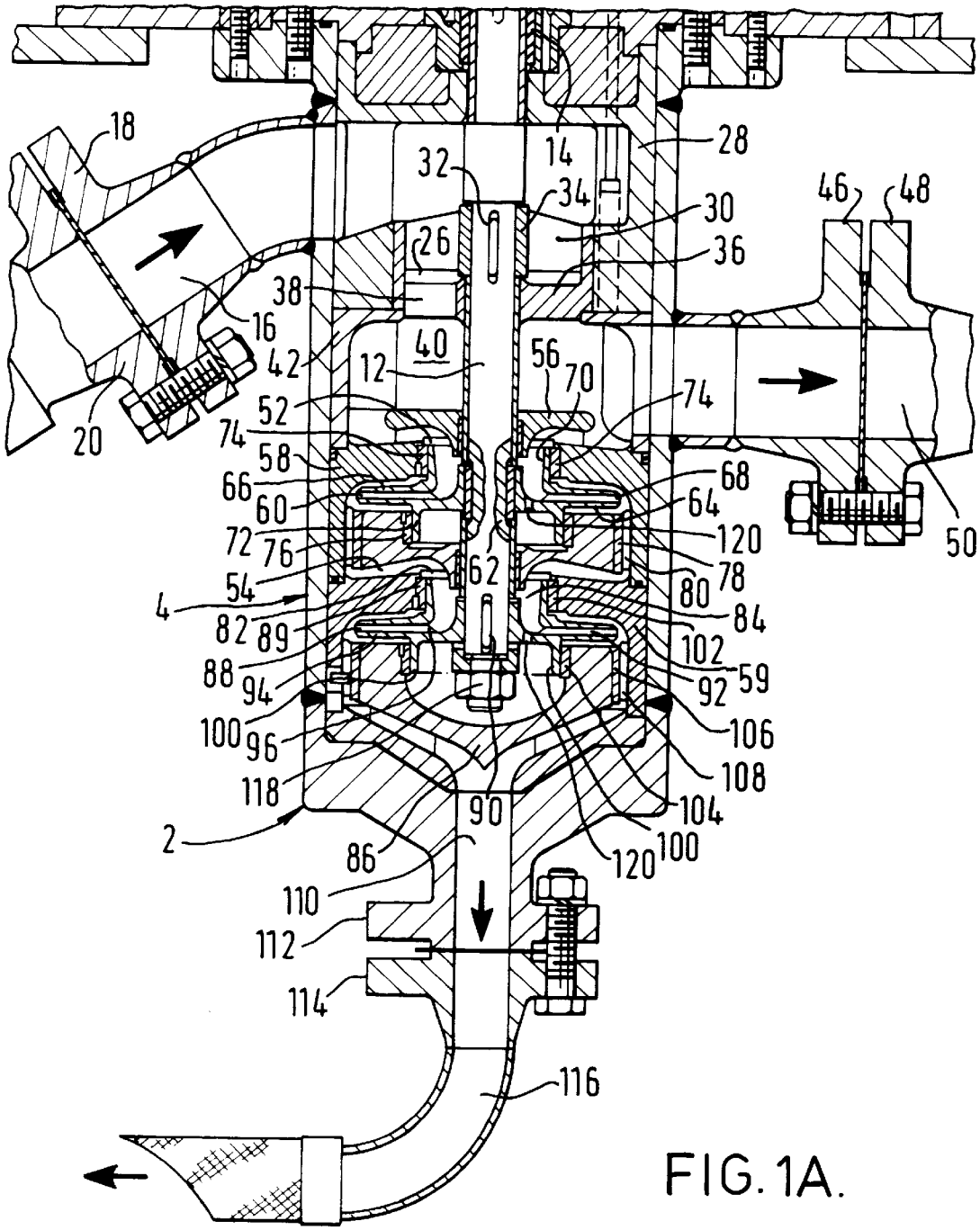
FIG. 1A is a schematic sectional elevation of the main body of a first cryogenic rotary pump according to the invention.
Figure 1B:
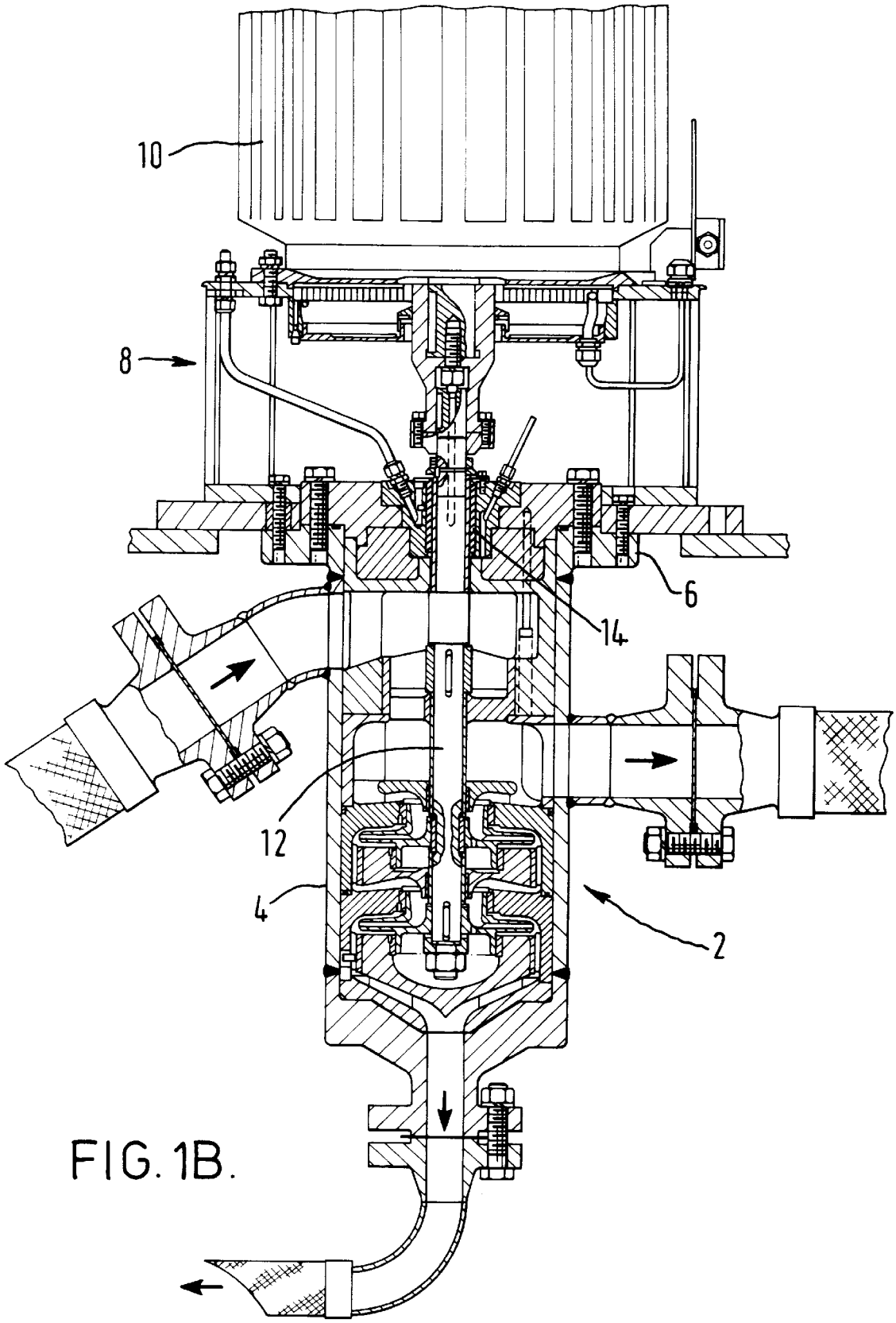
FIG. 1B is a schematic sectional elevation of the pump illustrated in FIG. 1A so as to illustrate the connection of the main body of the pump to an electrical motor which drives the pump.

With reference to FIGS. 1A and 1B, and particularly first to FIG. 1B, of the drawings, there is shown a cryogenic rotary pump 2 having a generally cylindrical housing 4 located with its longitudinal axis vertical and having at one end a flange 6 which is secured to the support 8 (sometimes referred to as a "lantern") of an electric motor 10. The cryogenic pump has an axial drive shaft 12 which is directly coupled to the electric motor 10. The coupling engages a labyrinthine seal 14 so as to prevent leakage of fluid from the pump into the motor 10.

With reference now to FIG. 1A, the cryogenic rotary pump 2 has an inlet 16 provided with a flange 18 which is coupled to a complementary flange 20 of an inlet pipeline 22 communicating with a source (not shown) of cryogenic liquid to be pumped. The inlet 16 communicates with a first pumping chamber 26 defined within the housing 4 by a hollow insert 28 in frictional engagement with the inner surface of the housing 4. Located within the chamber 26 is an inducer 30 in the form of a helical blade which is connected by a key 32 to the drive shaft 12. The inducer 30 is carried on a hub 34 mounted on the shaft 12. In operation, rotation of the drive shaft 12 causes the inducer 30 to urge the cryogenic liquid in a generally axial direction through a diffuser 36 having guide vanes 38 which provide communication between the first pumping chamber 26 and a liquid receiving chamber 40 located downstream of and coaxial with the first pumping chamber 26. The pumping action created by rotation of the inducer 30 is typically sufficient to raise the pressure of the liquid by an amount in the range of 1 to 2 bar depending on the extent and dimensions of the helical blade and its speed of rotation. For such different pressure requirements the diffuser housing 36 and the inducer 30 may be easily exchanged for new parts.

The liquid receiving chamber 40 is bounded in part by an appropriately shaped, hollow, generally cylindrical insert 42 which is in frictional engagement with the inner surface of the housing 4. The liquid receiving chamber 40 communicates at its side with an intermediate outlet 44 ("the first outlet" referred to above) for cryogenic liquid from the pump 2. The outlet 44 has a flange 46 which is coupled to a complementary flange of a pipeline 50 leading to apparatus (not shown in FIG. 1) in which the cryogenic liquid is employed. The liquid receiving chamber 40 also has at its end remote from the diffuser 36 an axial outlet 52 communicating with a second pumping chamber 54. A baffle 56 is provided in the liquid distribution chamber 40 so as to prevent straight line flow from the diffuser 36 to the outlet 52 of the liquid that does not pass to the outlet 44. The second pumping chamber 54 is bounded by appropriately shaped inserts 58 and 59 which are in frictional engagement with the inner surface of the housing 4. The insert 58 is integral with the baffle 56. A first impeller 60 is mounted on the drive shaft 12 and is held in position by a pair of keys 62. The first impeller 60 is located within the second pumping chamber 54, and is formed as an integral casting which has a lower disc 64 and an upper disc 66 spaced axially apart from one another such that an annular recess is defined therebetween. One or both of the discs 64 and 66 are formed with integral curved blades 68 which extend thereacross and project into the recess. The blades 68 are shaped and arranged in a manner well known in the art such that, in operation, rotation of the first impeller 60 by the drive shaft 12 causes liquid entering the second pumping chamber 54 from the liquid receiving chamber 40 to be urged by centrifugal force radially outwardly along progressively narrowing passages defined by the discs 64 and 66 and blades 68. The liquid is thereby raised in pressure. Typically an increase in pressure in the order of 8 to 12 bar can be achieved.

The first impeller 60 is provided with an upwardly extending collar 70 and a downward extending collar 72. The collar 70 is provided with an annular labyrinthine bearing 74 which is pinned or otherwise secured to the insert 56. Similarly, the collar 74 is provided with an annular labyrinthine bearing 76 which is pinned or otherwise secured to the insert 58.

The inserts 58 and 59 are shaped so as to define an axial annular channel in which is located a diffuser 78 having guide vanes 80. The diffuser 78 is positioned so as to receive liquid, in operation of the pump 2, from the periphery of the first impeller 60. Pressurised liquid flows from the diffuser 78 to an outlet 82 of the second pumping chamber 54 communicating with a third pumping chamber 84. The outlet 82 is positioned coaxially with and below the outlet 52 from the liquid receiving chamber 40.

The third pumping chamber 84 is bounded by the insert 59 and another insert 86 which is in engagement with the bottom of the housing 4. A second impeller 88 is mounted on the drive shaft 12 and is held in position by a pair of keys 90. The second impeller 88 is located within the third pumping chamber 84, and is generally identical to the first impeller 60, being formed as an integral casting which has a lower disc 92 and an upper disc 94 spaced axially apart from one another such that an annular recess is defined therebetween. One or both of the discs 92 and 94 are formed with integral curved blades 96 which extend thereacross and project into the recess. The blades 96 are shaped and arranged such that, in operation, rotation of the second impeller 88 by the drive shaft causes liquid entering the third pumping chamber 84 from the second pumping chamber 54 to be urged by centrifugal force radially outwardly along progressively narrowing passages defined by the discs 92 and 94 and blades 96. The liquid is thus raised in pressure, typically by a further 10 to 12 bar.

The second impeller 88 is provided with an upwardly extending collar 98 and a downwardly extending collar 100. The collar 98 is provided with an annular labyrinthine bearing 102 which is pinned or otherwise secured to the insert 59. Similarly the collar 100 is provided with an annular labyrinthine bearing 104 which is pinned or otherwise secured to the insert 86.

The inserts 59 and 86 are shaped so as to define an axial annular channel in which is located a diffuser 106 having guide vanes 108. The diffuser 106 is positioned so as to receive liquid, in operation of the pump, from the periphery of the second impeller 88. Pressurised liquid flows from the diffuser 106 to an axial outlet 110 (referred to hereinabove as "the second outlet") at the bottom of the pump 2. The outlet 110 has a flange 112 which is coupled to a complementary flange 114 of a pipeline 116 leading to an apparatus (not shown in FIG. 1) in which the pressurised liquid, now typically at a pressure in the range of 16 to 25 bar is used.

The bottom of the drive shaft 12 is provided with a nut 118 which can be removed to enable the impellers to be removed from the drive shaft 12.

Typically, the housing 4 is formed of stainless steel. The drive shaft 12 is also formed of stainless steel, but of a martensitic kind. Internal parts of the pump are preferably formed as bronze castings.

The impellers 60 and 88 typically have balancing holes 120 formed therethrough.

In operation of the pump shown in FIG. 1, the drive shaft 12 is typically driven at a velocity of 3000 revolutions per minute (or 3600 rpm for 60 Hz net) and the pump 2 is operated continuously. A 150 to 400 kilowatt electric motor generally suffices for this duty. Typically, the pump is arranged such that about two-thirds of the incoming cryogenic liquid, for example liquid oxygen, leaves through the intermediate outlet 44 and the remainder through the bottom outlet 110. If there is but a single impeller, the motor may drive the shaft 12 at a higher velocity, eg 4000 to 7000 revolutions per minute.

Figure 2:
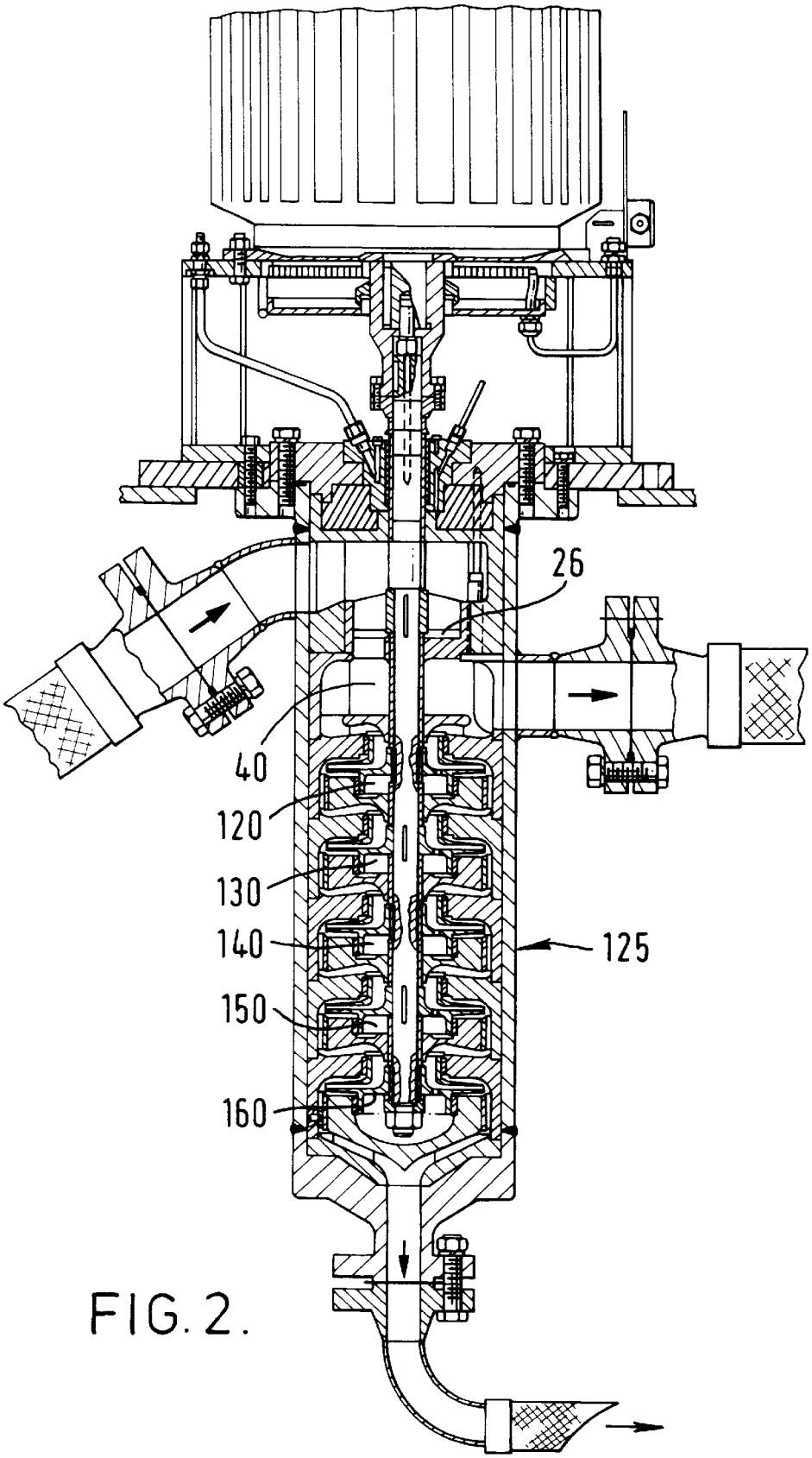
FIG. 2 is a schematic sectional elevation of a second cryogenic rotary pump according to the invention.

The cryogenic rotary pump 125 shown in FIG. 2 is very similar to the one shown in FIG. 1 of the drawings. Whereas the pump shown in FIG. 1 has two high pressure pumping stages downstream of the liquid receiving chamber 40, one such stage being located in the second pumping chamber 54, the other in the third pumping chamber 84, the pump shown in FIG. 2 has five high pressure stages 120, 130, 140, 150, and 160 generally similar to the two high pressure stages of the pump shown in FIG. 1. The pump shown in FIG. 2 is able to deliver the second stream of cryogenic liquid at a pressure in the order of 40 to 60 bar, the precise pressure depending on the speed at which the motor 10 drives the shaft 12 and the diameter of each impeller. Any delivery pressure of the second stream of cryogenic liquid in the ranges of 20 to 60 bar can therefore be raised depending on the number of high pressure stages that are incorporated into the pump and their hydraulic design.

Figure 3:
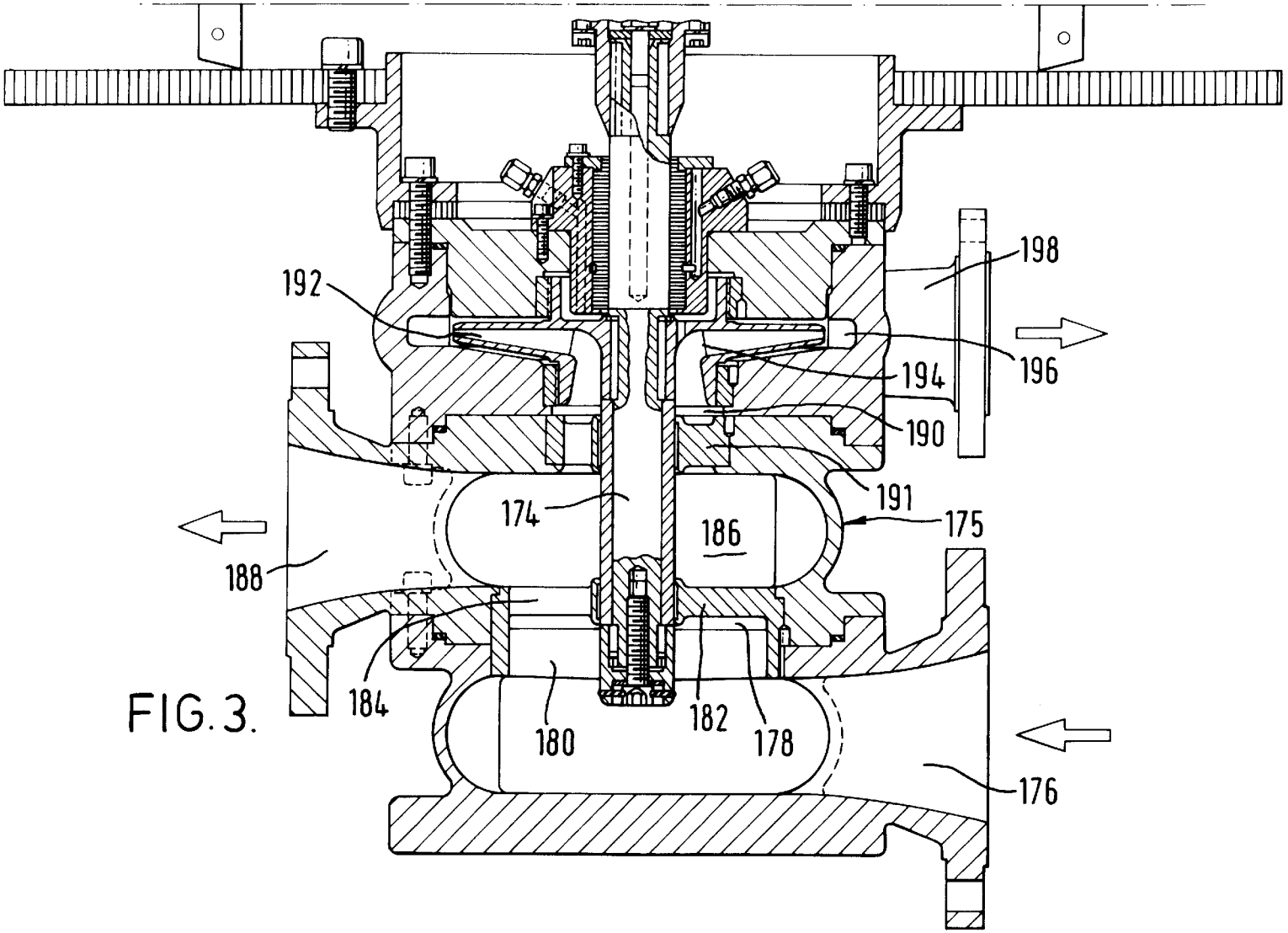
FIG. 3 is a schematic sectional elevation of a third cryogenic rotary pump according to the invention.

In FIG. 3 of the accompanying drawings there is shown a cryogenic rotary pump 175 which delivers the second stream of cryogenic liquid at a pressure in the order of 10 bar. In this pump, there is a single high pressure stage. Further whereas in the pumps shown in FIGS. 1 and 2 the inlet is at a greater elevation than the two outlets, in the pump shown in FIG. 3 the inlet is at a level below those of the two outlets.

The pump 175 has at a bottom region of the housing 170 an inlet 176. The inlet 176 communicates via an intermediate chamber 177 with a first pumping chamber 178 located within the housing 170. The first pumping chamber 178 has an inducer 180 in the form of a helical blade which is keyed to the drive shaft 174. In operation, rotation of the drive shaft 174 causes the inducer 180 to urge the cryogenic liquid upwardly in a generally axial direction through a diffuser 182 having guide vanes 184 which afford communication between the first pumping chamber 178 and a liquid receiving chamber 186 located thereabove. The pumping action created by the rotation of the inducer 180 is typically sufficient to raise the pressure of the liquid by an amount in the range of 1 to 2 bar (or to lift it to a height in the range of 10 to 20 meters) depending on the extent and dimensions of the helical blade and its speed of rotation.

The liquid receiving chamber 186 communicates at its side with a first outlet 188 for cryogenic liquid from the pump 175. The liquid receiving chamber 188 also communicates through guide vanes 191 at its top with a second pumping chamber 190 formed in the housing 170. An impeller 192 having upper and lower discs is keyed t o the drive shaft 174 within the second pumping chamber 190. The impeller 192 is generally similar to the impeller 60 of the cryogenic rotary pump 2 shown in FIG. 1. It has integral curved blades 194. The blades 194 are shaped and arranged in a manner well known in the art such that, in operation, rotation of the impeller 192 by the drive shaft 174 causes liquid entering the second pumping chamber 190 to be urged by centrifugal force radially outwards along progressively narrowing passages defined by the upper and lower discs of the impeller 192 and the blades 194. The liquid is thereby raised in pressure. The second pumping chamber has an outer spiral shaped annular peripheral region 196 which receives pressurised liquid from the impeller 192 and which communicates with a second outlet 198 from the pump 175.

Typically, in operation of the pump 175 the shaft 174 may be driven at a higher velocity (eg up to 7000 rpm) than the pump 2 shown in FIG. 1.

Figure 4:
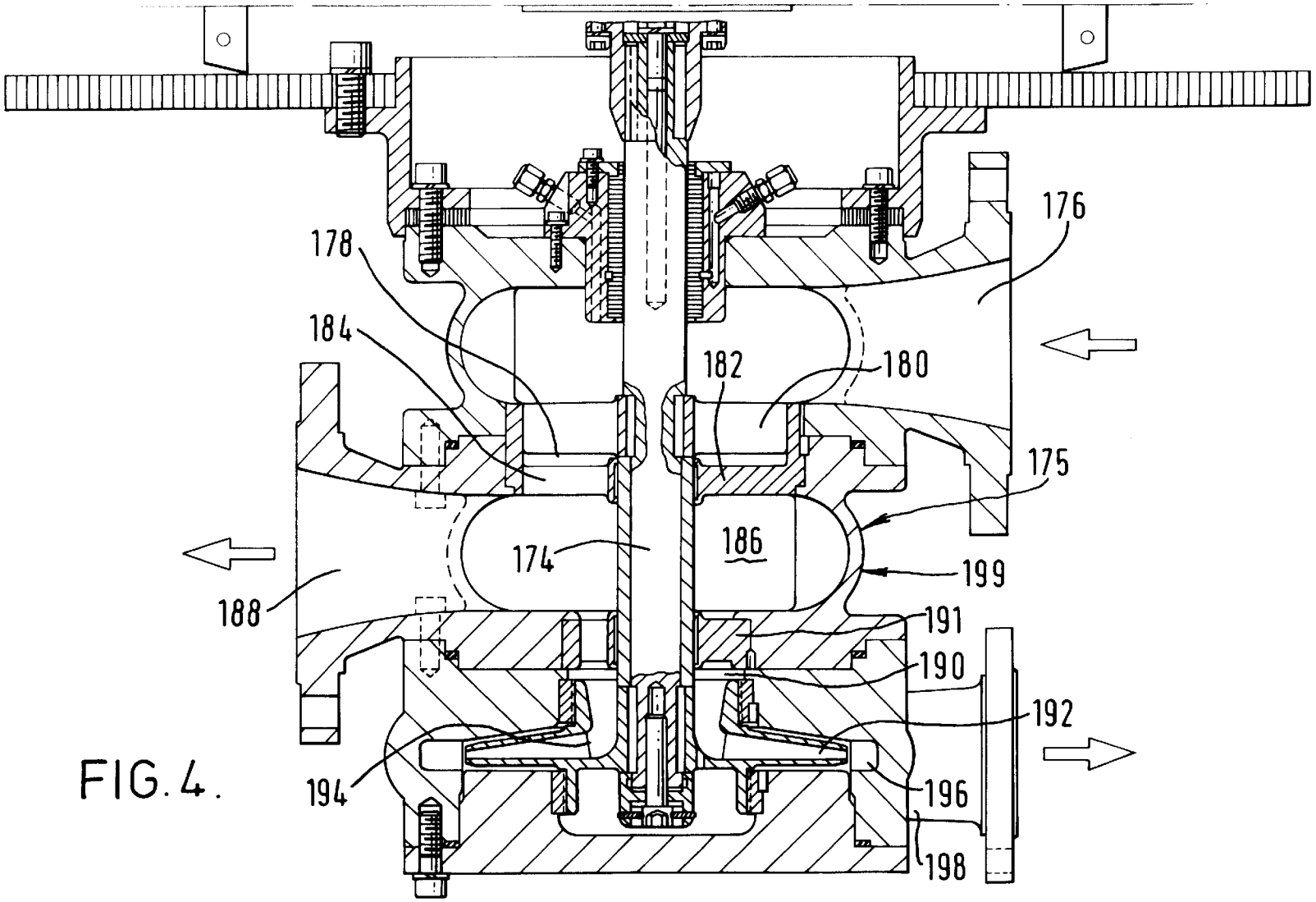
FIG. 4 is a schematic sectional elevation of a fourth cryogenic rotary pump according to the invention.

In FIG. 4 of the accompanying drawings there is shown a cryogenic rotary pump 199 which delivers the second stream of cryogenic liquid at a pressure in the order of 10 bar. In this pump, there is also a single high pressure stage. Further whereas in the pump shown in FIG. 3 the inlet is at a level below those of the two outlets, in the pump shown in FIG. 4 the inlet is a greater elevation than the two outlets, that is the same configuration as in the pumps shown in the FIGS. 1 and 2. The individual components of the pump 199 and their operation are essentially the same as in the pump shown in FIG. 3, so will not be described further below.

Figure 5:
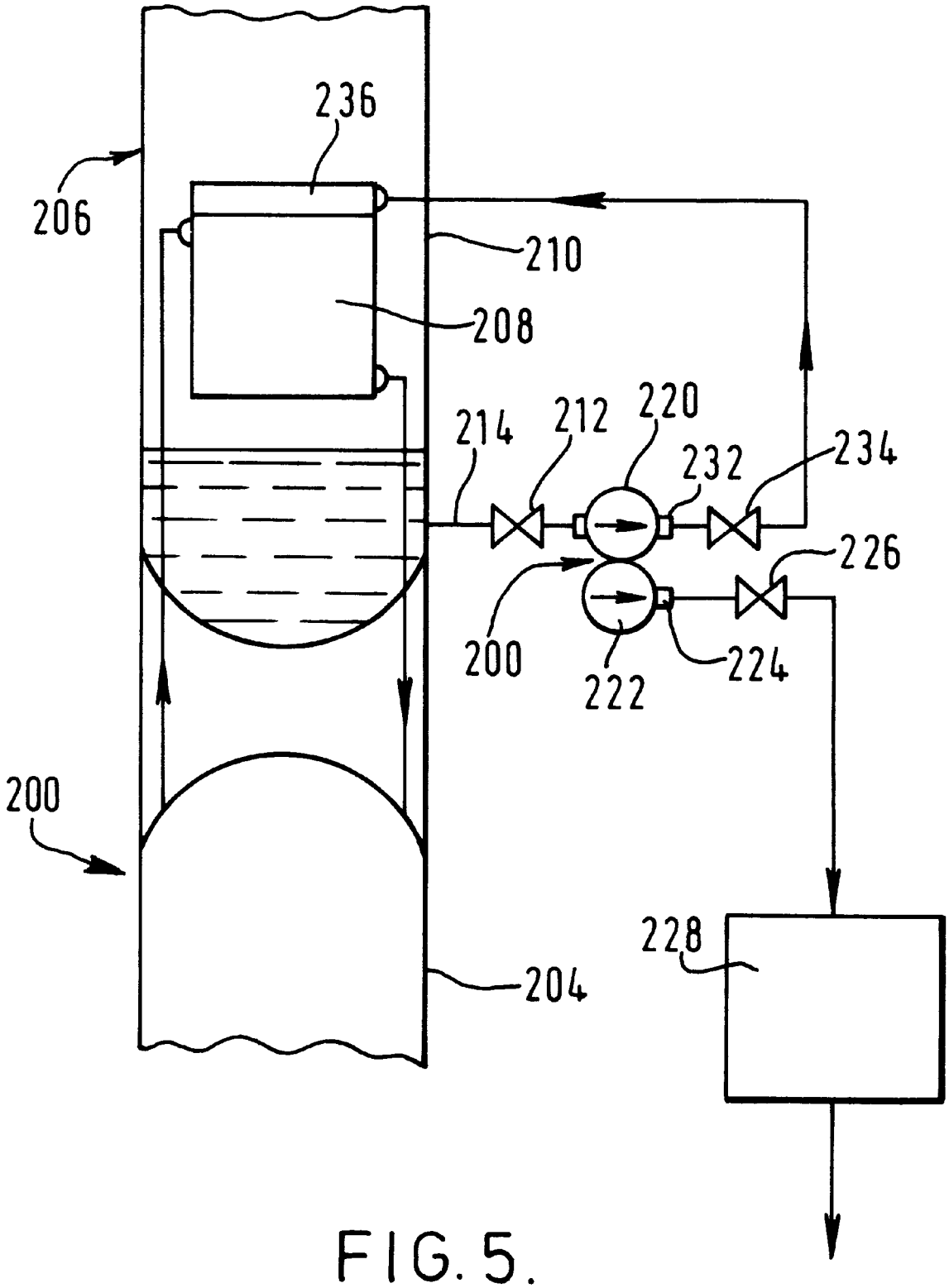
FIG. 5 is a schematic flow diagram of part of an air separation apparatus including a cryogenic rotary pump according to the invention.

Referring now to FIG. 5, there is illustrated part of an air separation plant which incorporates a cryogenic rotary pump 200 according to the invention. The plant includes a double rectification column 202 comprising a higher pressure rectification column 204, a lower pressure rectification column 206 and a condenser-reboiler 208 placing the top of the higher pressure rectification column 204 in a heat exchange relationship with the bottom of the lower pressure rectification column 206. The reboiling passages (not shown) of the condenser-reboiler 208 are of the downflow type. For ease of illustration, only a top section of the higher rectification column 204 and a bottom section of the lower pressure rectification column 206 are shown in FIG. 5. The condenser-reboiler 208 is located in the sump 210 of the lower pressure rectification column 206, above a volume of liquid oxygen which may be pure or impure.

In operation, nitrogen vapour separated in a higher pressure rectification column 204 is condensed in the condenser-reboiler 208 and at least part of the resulting condensate is returned to the higher pressure rectification column 204. The condensation is effected by indirect heat exchange with liquid oxygen separated in a lower pressure rectification column 208. The liquid oxygen collects in the sump 210 of the lower pressure rectification column 206. The lower pressure rectification column 206 has an outlet 214 for the liquid oxygen communicating with the sump 210 and, via shut-off valve 212, with the inlet to the pump 200. The pump 200 has a first low pressure stage 220 and one or more high pressure stages 222. There is a first outlet 232 for the liquid oxygen which communicates via flow control valve 234 with a header 236 at the top of the condenser-reboiler 208. The liquid oxygen flows down the reboiling passages and a part of it is vaporised. The remaining liquid oxygen falls under gravity into the volume of liquid in the sump 210.

The pump also has a second outlet 224 from the high pressure stage or series of high pressure stages 222 which communicate via a flow control valve 226 with a heat exchanger 228 which is employed to vaporise the liquid oxygen (assuming the oxygen is at a sub-critical pressure). Typically, the heat exchanger 228 may be either the main heat exchanger of the air separation plant and not only is the oxygen vaporised therein, it is also warmed to approximately ambient temperature.

If there is a single high pressure stage the pump according to the invention is typically able to raise the pressure of the liquid oxygen to a pressure of 20 bar. However, by using, two, or three to eight such stages, it is possible to produce oxygen at pressures of up to 60 bar or above.

Although one use of a cryogenic rotary pump according to the invention is in simultaneously pumping a first stream of liquid oxygen to the head of a downflow reboiler and a second stream of liquid oxygen to a higher pressure to enable it to be taken as an elevated pressure product, the cryogenic rotary pump may be put to any other use in which a cryogenic liquid is simultaneously required at two different pressures.

I claim:

1. A cryogenic rotary pump for pressuring a flow of a cryogenic liquid and for dividing the flow into a first lower pressure stream and a second higher pressure stream, including:

- a plurality of pumping chambers in series with one another;
- a single rotary drive shaft carrying all rotary pumping members;
- a liquid receiving chamber intermediate a pair of said pumping chambers;
- a first outlet from the pump for the lower pressure stream, the first outlet being contiguous to the liquid receiving chamber; and
- a second outlet from the pump for the second higher pressure stream downstream of the series of pumping chambers.

2. The cryogenic rotary pump according to claim 1, wherein there is only one pumping chamber upstream of the liquid receiving chamber.

3. The cryogenic rotary pump according to claim 2, wherein the pumping member in the upstream chamber is of an axial kind.

4. The cryogenic rotary pump according to claim 3, wherein the pumping member in the upstream chamber comprises a helical blade.

5. The cryogenic rotary pump according to claim 1, wherein each of said pumping chambers downstream of the liquid receiving chamber has associated therewith a radial rotary pumping member.

6. The cryogenic rotary pump according to claim 5, wherein the radial rotary pumping member takes the form of an impeller having blades which urge the fluid being pumped in a generally radial direction.

7. The cryogenic rotary pump according to claim 1, in which there is a diffuser located downstream of each pumping member.

8. The cryogenic rotary pump according to claim 7, wherein the diffuser has blades of a variable angle kind.

9. The cryogenic rotary pump according to claim 1, additionally including a variable speed electric motor for driving the rotary drive shaft.

10. A cryogenic air separation apparatus including:

a double rectification column for separating the air comprising, a higher pressure column, a lower pressure column, and a condenser-downflow reboiler placing an upper region of the higher pressure column in heat exchange relationship with a lower region of the lower pressure rectification column, a sump for receiving unboiled liquid oxygen from the downflow reboiler, an outlet for unboiled liquid oxygen from the sump; and a cryogenic rotary pump for pressurizing a flow of the unboiled liquid oxygen from the sump and for dividing the flow of the unboiled liquid oxygen into a first lower pressure stream and a second higher pressure stream;

the cryogenic liquid pump including, a plurality of pumping chambers in series with one another, a single rotary drive shaft carrying all rotary pumping members, a liquid receiving chamber intermediate a pair of pumping chambers, a first outlet from the cryogenic rotary pump for the first lower pressure stream communicating with an inlet to the downflow reboiler, the first outlet being contiguous to the liquid receiving chamber, and a second outlet from the cryogenic rotary pump for the second higher pressure stream downstream of the series of pumping chamber, the second outlet communicating with heat exchange means for warming the second higher pressure stream.

* * * * *

UNITED STATES PATENT AND TRADEMARK OFFICE

CERTIFICATE OF CORRECTION

PATENT NO. : 6,167,724
DATED : January 2, 2001
INVENTOR(S) : Josef Pozivil

It is certified that error appears in the above-identified patent and that said Letters Patent is hereby corrected as shown below:

Title page,
Item 73 The BOC Group plc (GB) replace "The BOC Group plc" with --Cryostar France SA (FR)--.

Signed and Sealed this

Third Day of July, 2001

*Attest:*

Nicholas P. Godici

*Attesting Officer*

NICHOLAS P. GODICI
*Acting Director of the United States Patent and Trademark Office*